US007645151B2

(12) United States Patent
Moll et al.

(10) Patent No.: US 7,645,151 B2
(45) Date of Patent: Jan. 12, 2010

(54) SHUNTED ELECTRICAL CONNECTOR AND SHUNT THEREFORE

(75) Inventors: Hurley Chester Moll, Harrisburg, PA (US); John Mark Myer, Millersville, PA (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 11/810,288

(22) Filed: Jun. 5, 2007

(65) Prior Publication Data

US 2008/0233778 A1 Sep. 25, 2008

Related U.S. Application Data

(60) Provisional application No. 60/919,445, filed on Mar. 22, 2007.

(51) Int. Cl.
*H01R 29/00* (2006.01)

(52) U.S. Cl. ..... 439/188

(58) Field of Classification Search ..... 439/188, 439/189, 441, 488, 630; 200/51.1
See application file for complete search history.

(56) References Cited

U.S. PATENT DOCUMENTS

| | | | | | |
|---|---|---|---|---|---|
| 4,726,787 | A * | 2/1988 | Stine | 439/510 |
| 5,435,754 | A | 7/1995 | Hotea et al. | |
| 5,494,450 | A * | 2/1996 | Kirsch et al. | 439/188 |
| 5,669,787 | A * | 9/1997 | Miyazawa | 439/510 |
| 5,863,216 | A * | 1/1999 | Tsuji et al. | 439/489 |
| 6,000,975 | A * | 12/1999 | Feldman | 439/857 |
| 6,159,028 | A * | 12/2000 | Bernardet et al. | 439/188 |
| 6,338,634 | B1 * | 1/2002 | Yu | 439/83 |
| 6,692,277 | B2 * | 2/2004 | Hu et al. | 439/188 |
| 6,899,556 | B2 * | 5/2005 | Nishida et al. | 439/188 |
| 7,108,711 | B2 * | 9/2006 | Vogel et al. | 607/1 |

* cited by examiner

*Primary Examiner*—Jean F Duverne

(57) ABSTRACT

An electrical connector is disclosed having a shunt member disposed between terminals in an electrical connector to shunt them together. The shunt member has shunt contacts defined by turned up portions from an edge of the members.

19 Claims, 11 Drawing Sheets

SHUNTED ELECTRICAL CONNECTOR AND SHUNT THEREFORE

This application claims priority from Provisional Patent Application Ser. No. 60/919,445, the entirety of which is incorporated herein by reference.

BACKGROUND OF INVENTION

The subject embodiment relates to an electrical connector, and particularly to a shunted electrical connector.

It is sometimes required to provide in an electrical connector, a shunting member which shunts between terminals, sometimes adjacent terminals. This is true in the application of air bag connectors which are connected to igniters. In an airbag igniter system, where the electrical connection is made with the igniter, a suppression device is sometimes also placed between adjacent terminals to suppress the signal of the igniter. Typically such connections also require the shunting feature, which shunts between adjacent contacts when in a disconnected mode, whereby the connection of the two connectors breaks the shunt allowing the connection with the igniter.

SUMMARY OF INVENTION

An electrical shunt member according to the present application is comprised of a cantilever beam and a shunt contact adjacent a free end of the cantilever beam. The shunt contact includes at least one upstanding contact formed upwardly from an edge of the cantilever beam.

In another embodiment, an electrical connector, assembly comprises an insulating housing having a plurality of terminal receiving passageways, and a shunt contact receiving cavity substantially spanning at least two of said terminal receiving passageways. A plurality of electrical terminals is positioned in at least some of the terminal receiving passageways. An electrical shunt member is positioned in the shunt contact receiving cavity, and has at least two shunt contacts being movable between shunted and unshunted positions with selected electrical terminals, the shunt contacts comprising a longitudinal beam with the shunt contacts extending upwardly from an edge of the longitudinal beam.

DETAILED DESCRIPTION OF THE EMBODIMENT

Figure 1:
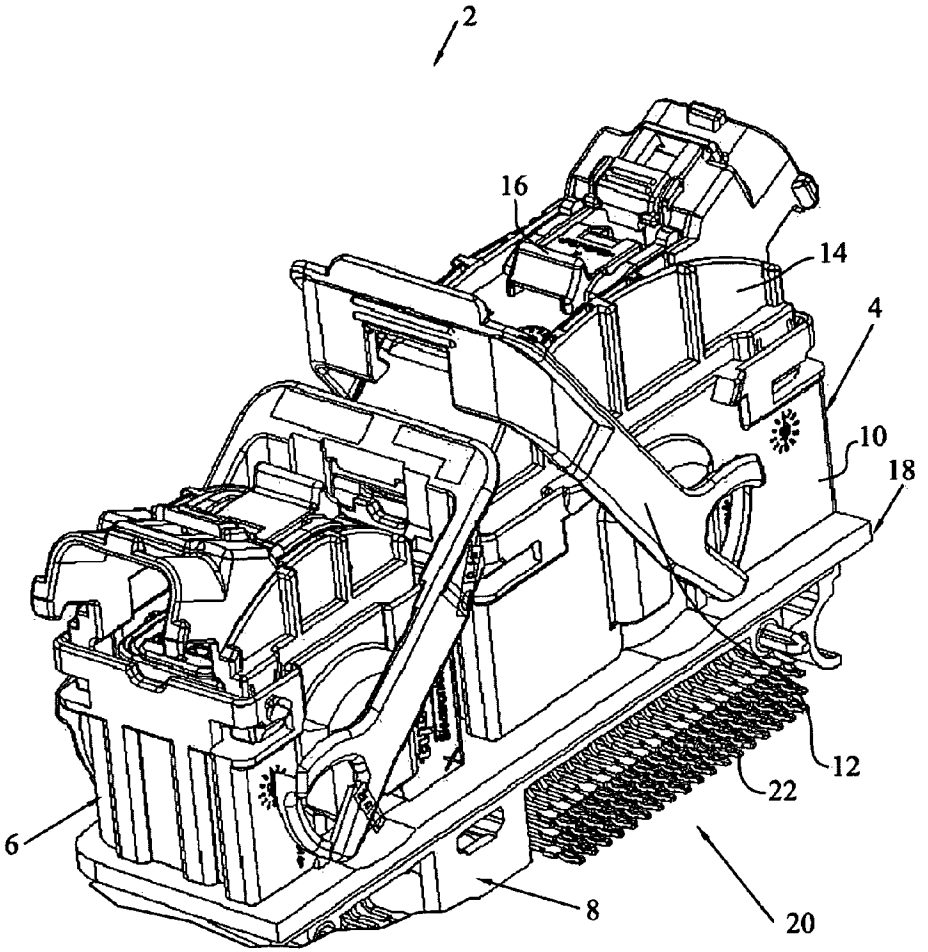
FIG. 1 shows a top perspective view of the electrical connector assembly of the present invention.

The embodiments disclosed below are not intended to be exhaustive or to limit the invention to the precise forms disclosed in the following detailed description. Rather, the embodiments are chosen and described so that others skilled in the art may utilize their teachings.

Corresponding reference characters indicate corresponding parts throughout the several views. Although the drawings represent embodiments of the present invention, the drawings are not necessarily to scale and certain features may be exaggerated in order to better illustrate and explain the present invention.

With reference first to FIG. 1, an electrical connector assembly is shown generally as 2 which comprises first and second plug connectors 4 and 6, both of which are electrically connected to a header connector 8. Each of the plug connectors 4 and 6 are virtually identical, except for their relative size and number of electrical terminals within the connectors. Therefore, only one of the plug connectors will be described in detailed. It should be understood that header connector 8 is only illustrative, and that any form of connector system could be incorporated herein, for example a single plug/header connector assembly shown in provisional application 60/919,437, (the disclosure of which is fully incorporated herein by reference) or an in-line style connector or various connectors with different terminal arrays.

As shown in FIG. 1, plug connector 4 is generally comprised of a plug housing 10, having a mating assist member 12 in the form of a lever, which straddles plug housing 10 and is rotatable in the clockwise and counterclockwise sense to move the connector into and out of mated conditions as is known in the art. The plug connector 4 further comprises a wire dress cover 14 having a connector position assurance member 16. Header connector 8 is comprised of a housing 18 having a plurality of pin contacts 20 with a plurality of printed circuit board contacts 22 shown in FIG. 1.

Figure 2:
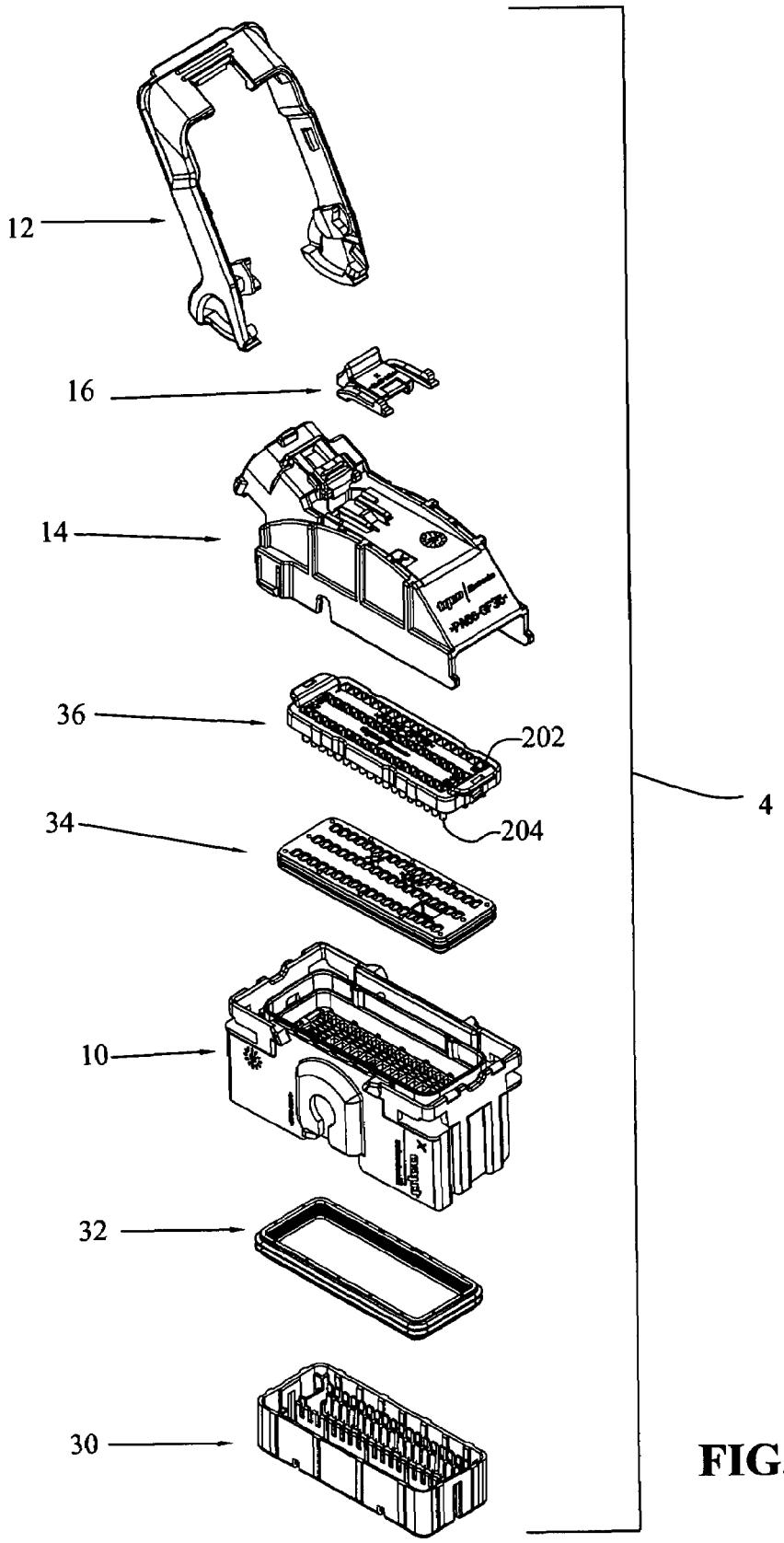
FIG. 2 shows an exploded view of one of the plug connectors of the present invention.

With respect to FIG. 2, most of the components of the plug connector 4 are shown in an exploded manner, and includes a terminal position assurance member 30, peripheral seal 32, plug housing 10 as mentioned above, a wire seal 34, a seal cover 36, wire dress cover 14, connector position assurance member 16 and mating assist lever 12. The assembly would also comprise a plurality of electrical terminals 140 (FIG. 14) and one or more shunt members 150 (FIG. 15). With the components as generally outlined above, each of the components will now be described in greater detail.

Figure 3:
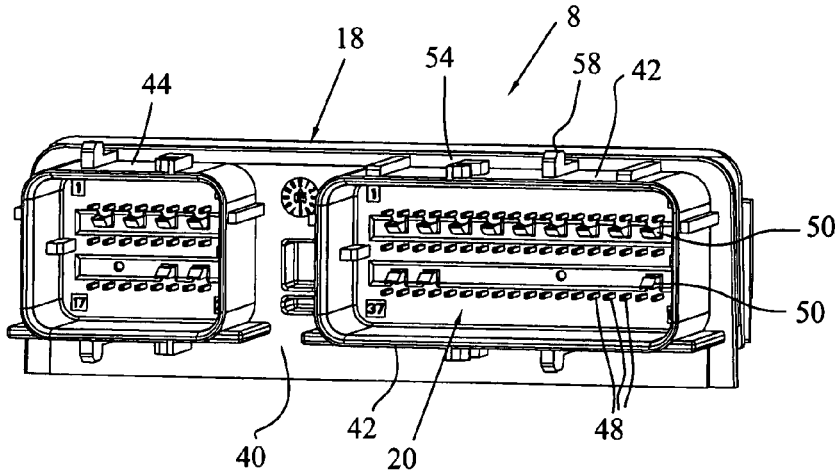
FIG. 3 shows a front perspective view of the header connector of the present invention.
Figure 4:
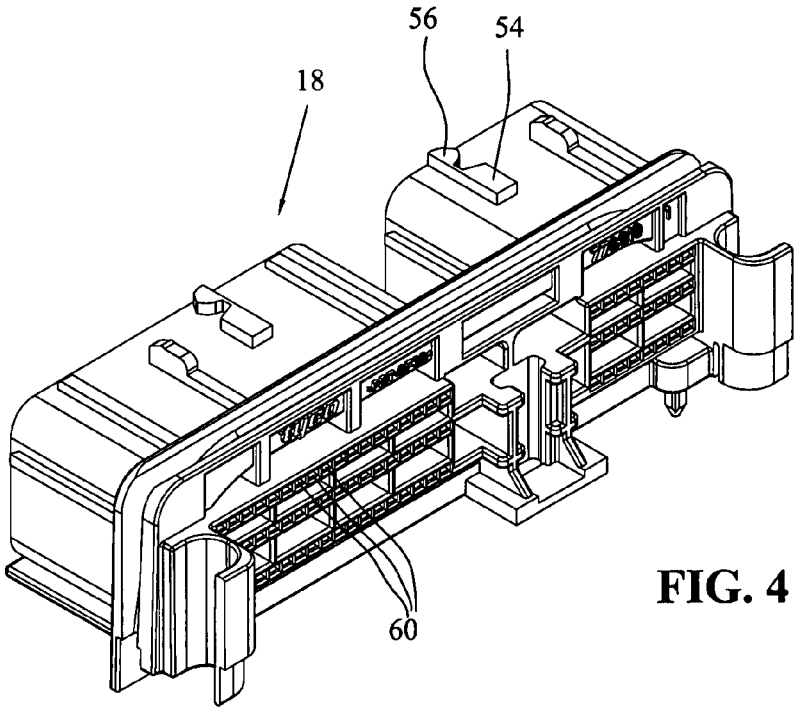
FIG. 4 shows a rear perspective view of the header connector of FIG. 3.

With reference now to FIGS. 3 and 4, header connector 8 is shown where housing 18 is generally comprised of a front wall 40 having first and second shrouds 42, 44, which correspond in size with plug connectors 4 and 6, respectively. Shroud 42 surrounds and protects the plurality of contacts 20, which as viewed in FIG. 3, also include pin terminals 48, which as should be appreciated to those skilled in the art, are connected to printed circuit board contacts 22 described above. Extending intermediate some of the pin terminals 48 are cam members 50, which operate a shunt member 150 within the plug connector 4, as will be described in further detail herein. With respect to FIG. 4, a plurality of apertures are provided at 60 for receipt therethrough of the plurality of contacts 20.

Figure 5:
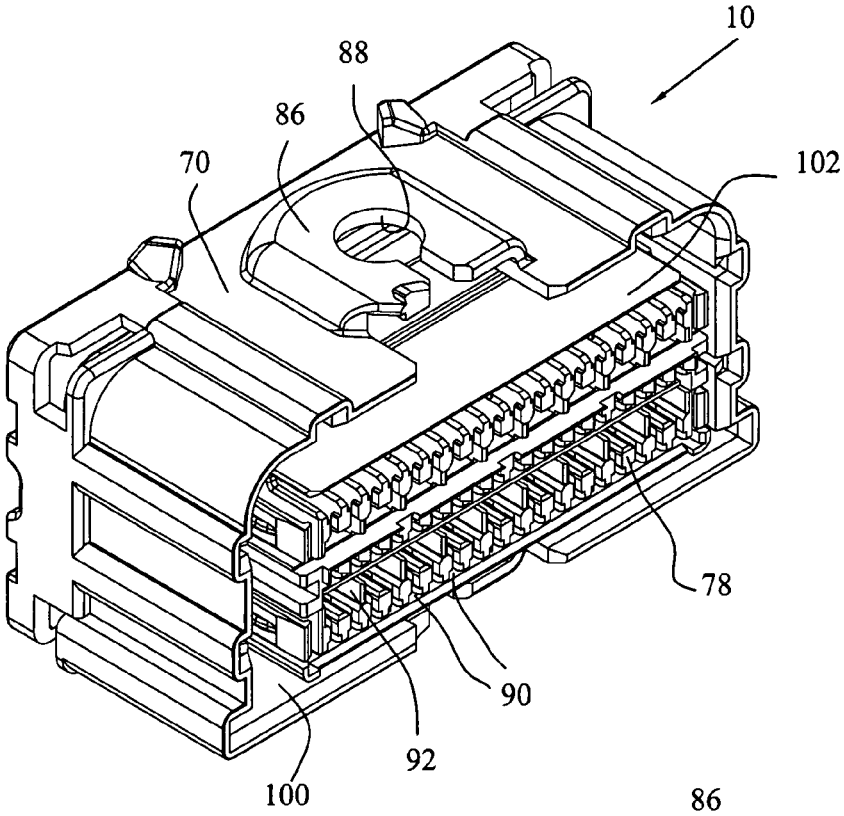
FIG. 5 shows a front perspective view of the plug housing of the present invention.
Figure 6:
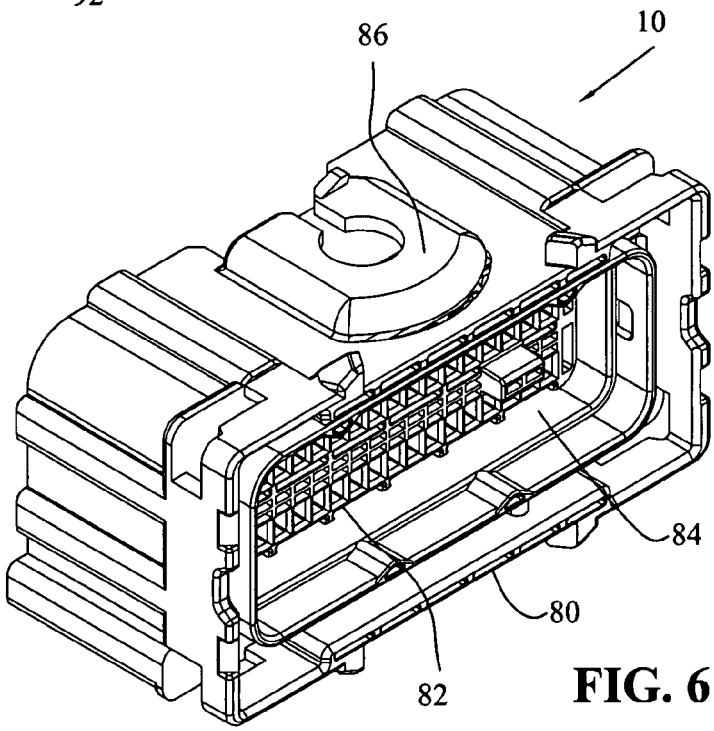
FIG. 6 shows a rear perspective view of the plug housing of FIG. 5.
Figure 7:
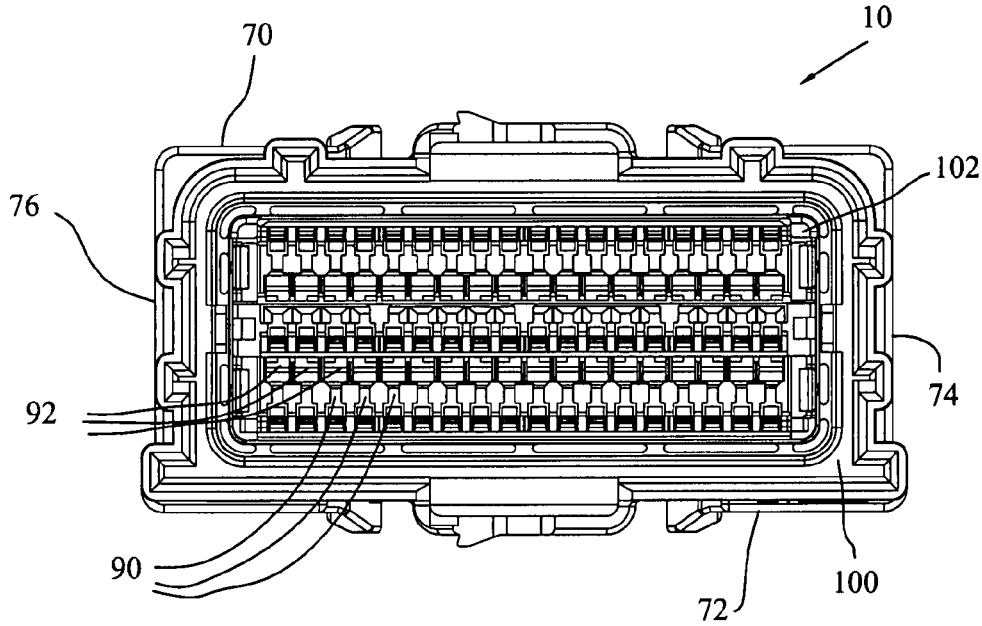
FIG. 7 shows a front plan view of the plug housing of FIG. 5.

With reference now to FIGS. 5-7, plug housing 10 will now be described. With respect first to FIG. 7, plug housing 10 is generally comprised of a top wall 70, lower wall 72, side wall 74, and side wall 76. Plug housing 10 also includes a front face at 78 (FIG. 5). As shown in FIG. 6, plug housing 10 includes a rear face 80, an inner face 82 against which wire seal 34 will be received, and a sealing surface 84. As shown best in FIG. 5 or 6, side walls 70 and 72 include a raised wall at 86 which provides a keyhole aperture 88 for receipt of the lever.

Also as best shown in FIG. 7, plug housing 10 includes a plurality of terminal receiving passageways 90 with a plurality of shunt openings 92, where one of the shunt openings 92 spans at least two terminal receiving passageways 90, as described further herein. As best shown in FIGS. 5 and 7, walls 70-76 form an outer shroud for plug housing 10 with a peripheral channel 100 surrounding inner housing portion 102. As should be expected, peripheral channel 100 is profiled to be received over shroud 42 (FIG. 3) for interconnection of plug connector 4 with header connector 8 as further described herein.

Figure 8:
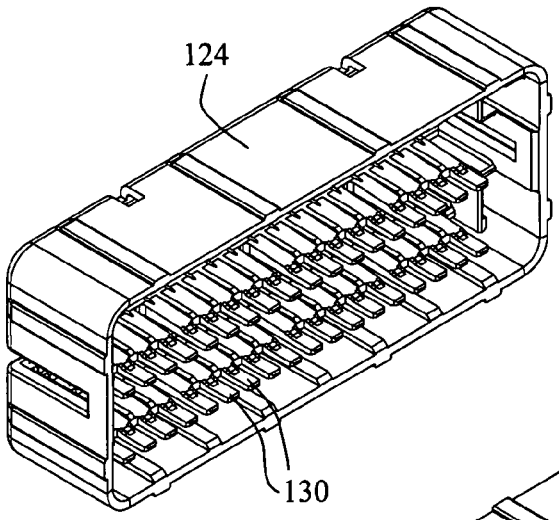
FIG. 8 shows a rear perspective view of the terminal position assurance member of the present invention.
Figure 9:
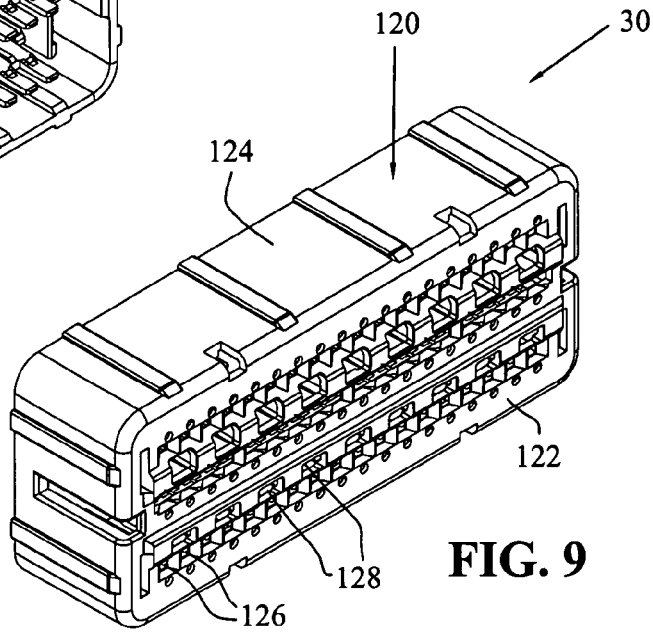
FIG. 9 shows a front perspective view of the terminal position assurance member of FIG. 8.

With reference now to FIGS. 8 and 9, terminal position assurance member 30 is shown as comprised of an insulative body 120 having a front face 122 and a peripheral shroud 124. As described herein, front face 122 defines the front mating face of the plug connector 4. A plurality of apertures 126 extend therethrough which will align with apertures 90 (FIG. 7) of plug housing 10. A plurality of access ports 128 are provided which laterally overlap apertures 126 and are profiled to align with apertures 92 (FIG. 7) as further described herein. Finally as shown in FIG. 8, terminal position assurance member 30 includes a plurality of back-up tines 130 is shown to assure a latching condition of contacts as described herein.

Figure 10:
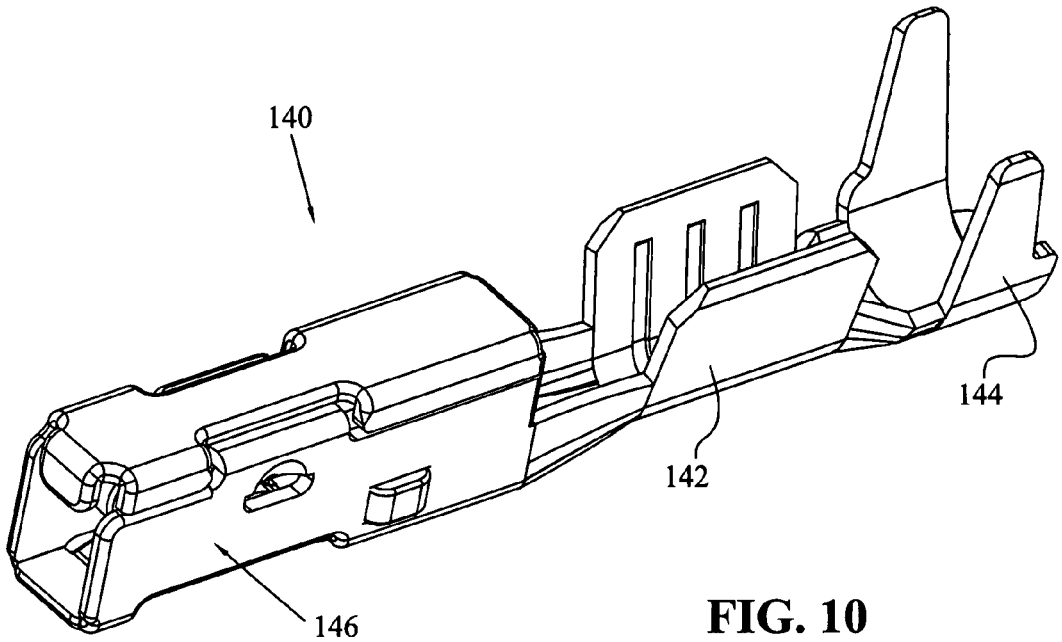
FIG. 10 shows a perspective view of the electrical terminal for use in the present invention.

With reference now to FIG. 10, an electrical terminal is shown as 140 which includes a wire crimp 142, strain relief 144 and a front socket portion 146 for contact with pin terminals 48 (FIG. 3) as further described herein. It should also be noted that terminal 140 is substantially the same as that described in Applicants' Patent Application Publication No. 2007/0021013 published on Jan. 25, 2007, the disclosure of which is fully incorporated herein by reference. However, as known to those skilled in the art, other terminal configurations are suitable for use with the electrical shunt member of the present invention.

Figure 11:
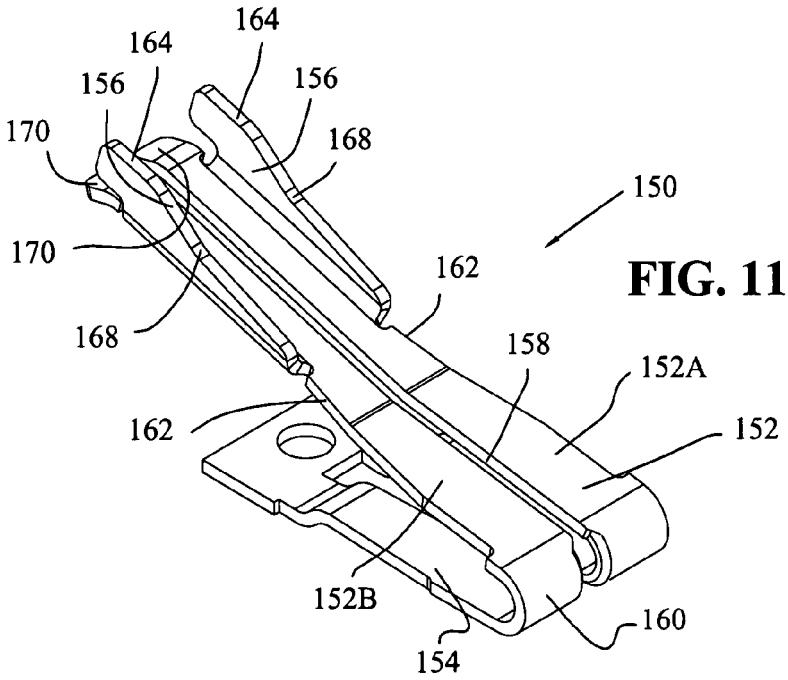
FIG. 11 shows a top perspective view of the electrical shunt member of the present invention.

With reference now to FIG. 11, an electrical shunt member 150 is shown which is comprised of a cantilever beam 152, a base portion 154 and shunt contacts 156. Cantilever beam 152 has a longitudinal seam at 158 to form two independent sections 152A and 152B. As shown, base portion 154 and cantilever beam 152 are reversely bent about a bight portion 160 where longitudinal seam 158 extends through the reverse bend of bight portion 160. Each of the shunt contacts 156 is formed by folding up the contacts 156 in an upstanding manner from side edges 162 of each of the sections 152A, 152B, and upstand in a direction opposite to the base portion 154. Each of the shunt contacts 156 includes an upper contact edge at 164 and an angled edge 168, which is defines as a camming edge. Angled edge 168 increases at an angle upwardly towards the contact edge 164. Finally, as also shown in FIG. 11, each of the sections 152A, 152B includes deflecting plates 170, adjacent the front edge thereof, and are angled downwardly towards the base portion 154.

Figure 12:
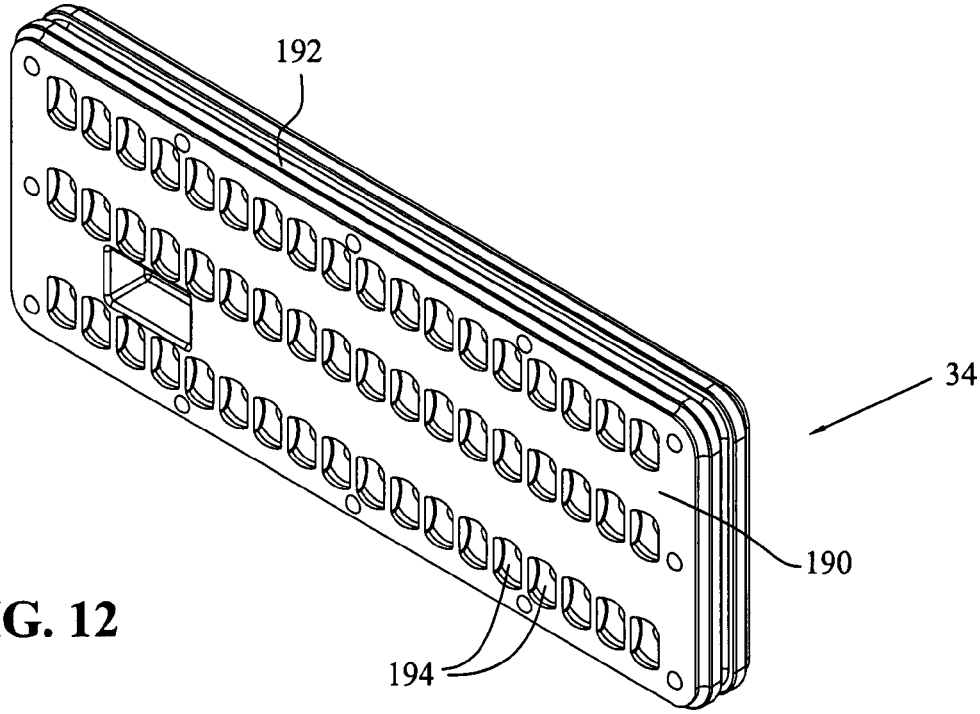
FIG. 12 shows a perspective view of the wire seal used in the present invention.

With respect now to FIG. 12, wire seal 34 is shown which is comprised of a substantially solid sealing material in the form of a body 190 having outer peripheral ribs at 192, and a plurality of apertures at 194 profiled to receive therethrough electrical terminals 140. It should be appreciated that each of the apertures 194 aligns with apertures 90 (FIG. 7) of plug housing 10, and apertures 126 (FIG. 9) of terminal position assurance member 30.

Figure 13:
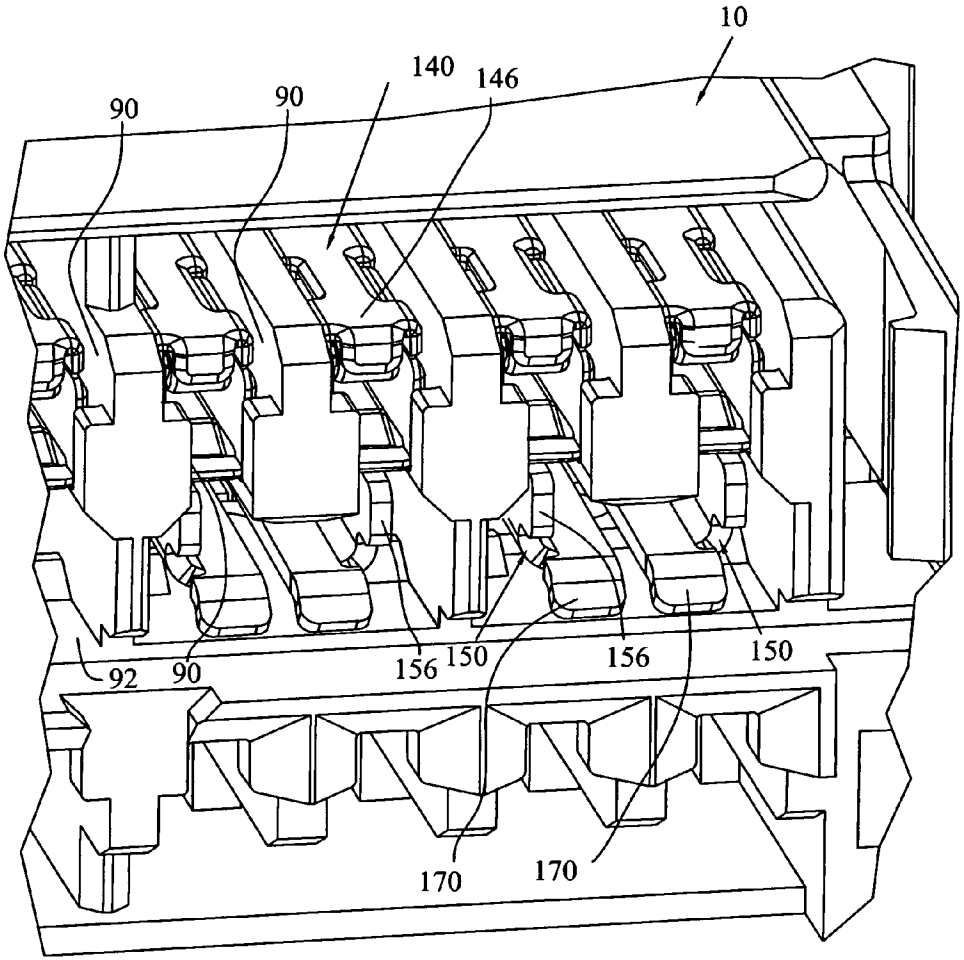
FIG. 13 shows a fragmented perspective view showing the electrical shunt member and the electrical terminals positioned in the plug housing without the terminal position assurance member in place.

To assemble the plug connector, electrical terminals 140 are then positioned within their respective terminal receiving passageways 90, through apertures 194 of seal 34, as best shown in FIGS. 13 and 15. Shunt members 150 are received in their respective passageways 92. FIG. 13 shows the front of the plug housing 10, without the terminal position assurance member 30 in position. As situated therein, each of the shunt contacts 156 of a single electrical shunt member 150 contact adjacent electrical terminals 140 in adjacent passageways 90. It should also be appreciated that the passageways 92 and the electrical shunt member 150 could be profiled to span one or more passageways 90 and shunt nonadjacent electrical terminals 140. Also due to the fact that the shunt member 150 has independent sections 152A and 152B, the shunt contact could be programmed (or reconfigured) to selectively move (or not move) to an unshunted position. It should also be appreciated that more than two shunt contacts 156 could be incorporated to shunt more than two contacts.

Figure 14:
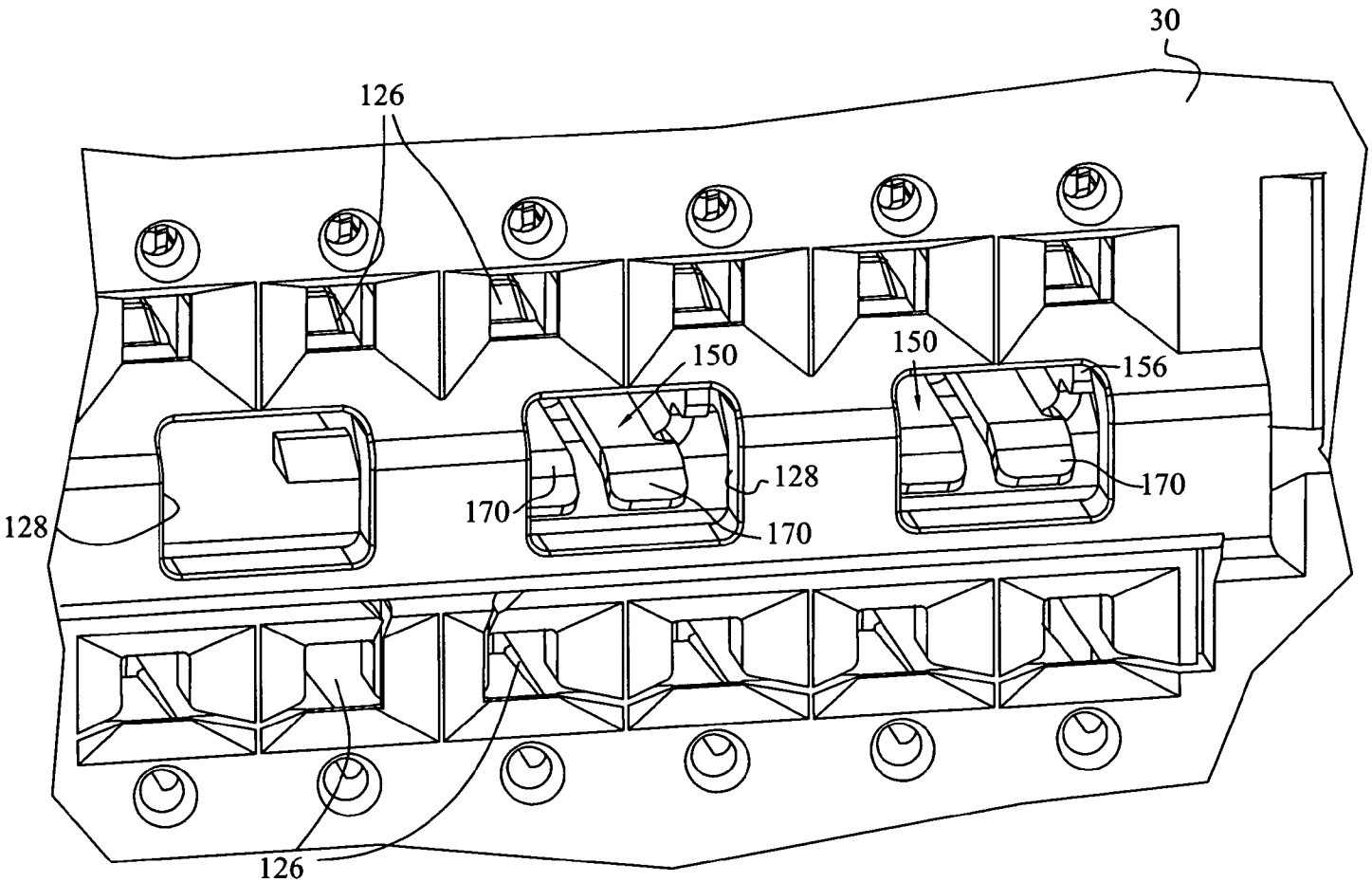
FIG. 14 is a view similar to that of FIG. 13 showing the terminal position assurance member in place.
Figure 15:
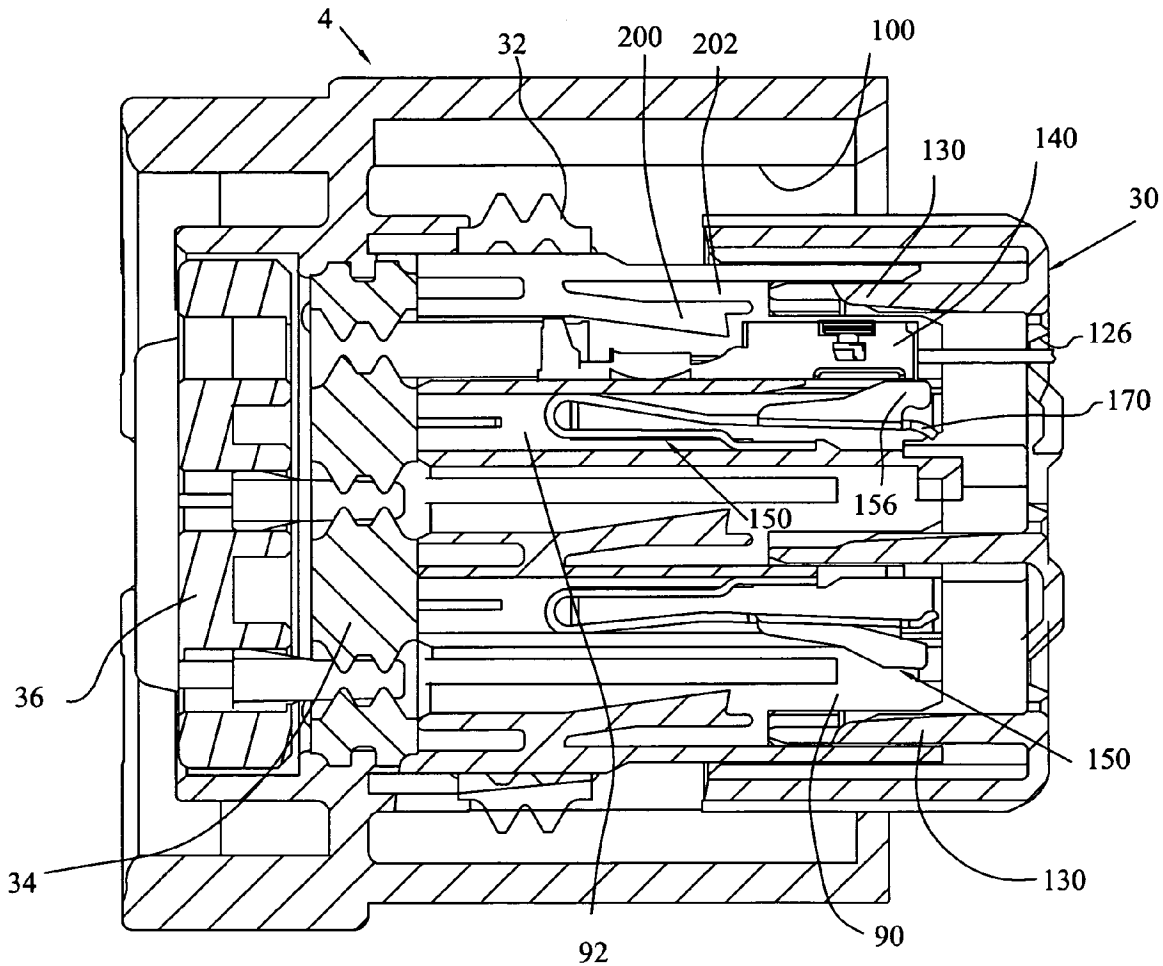
FIG. 15 shows a longitudinal cross-sectional view of the assembled plug housing, through two of the terminal receiving passageways, prior to connection with the header connector.

With respect now to FIG. 14, the terminal position assurance member 30 is now positioned over plug housing 10 (when in the condition shown in FIG. 13) and access ports 128 are shown aligning with individual electrical shunt members 150, and in particular with deflecting plates 170. Furthermore, apertures 126 are aligned with socket contact portions 146 of electrical terminals 140. It should be appreciated that apertures 128 would be programmed to align with cam members 50.

FIG. 15 shows a longitudinal cross-sectional view through the assembled plug connector 4 where the terminal position assurance member 30 is in a pre-locked condition, that is, for receipt of electrical terminals 140. In this position, back-up tines 130 are not yet positioned behind resilient latch arms 200 of plug housing 10. As is known in the art, the terminal position assurance member 30 is moveable to the left (as viewed in FIG. 15) such that back-up tines 130 fill gap 202 and backup the latch arm 200 to prevent deflection thereof.

As also shown in FIG. 15, peripheral seal 32 is shown in a surrounding relation around inner housing portion 102 of plug housing 10, and as shown, is profiled to seal an interior thereof within peripheral channel 100. Furthermore wire seal 34 and seal cover 36 are shown in position against the rear of plug housing 10. As also shown, shunt member 150 is shown fully positioned within shunt passageways 92 and shunt contact 156 is shown spring-loaded against electrical terminal 140.

With respect again to FIG. 1, to make electrical connection between plug connector 4 and header connector 8, the lever 12 is placed in the position shown in FIG. 1, and the plug connector 4 is aligned with peripheral channel 100 overlying shroud 42. Lever 12 can then be rotated to the right (clockwise) such that the rotation of lever 12, moves the connector pair 4, 8 into full electrical engagement. The full engagement is shown in FIG. 16.

Figure 16:
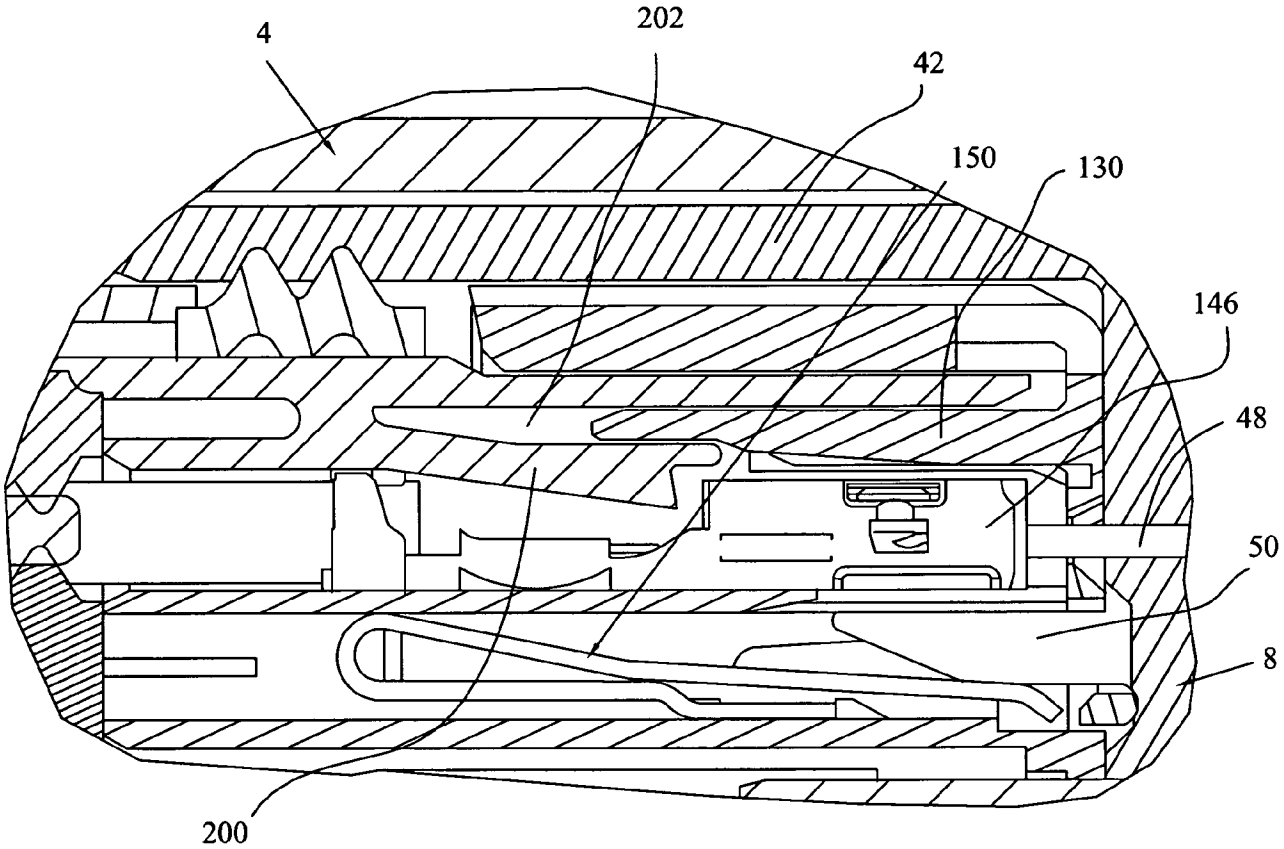
FIG. 16 shows a cross-sectional view similar to that of FIG. 15 showing the header connector in position.

As shown in FIG. 16, in the mated condition, pin terminals 48 are positioned within socket portions 146 of electrical terminals 140, cam members 50 have deflected shunt member 150 out of shunting relation with electrical terminals 140, and back-up fines 130 have moved to their fully forward position enclosing the gap 202 preventing deflection of latch 200.

Thus, as described, shunt member 150 allows versatility with shunting electrical terminals in adjacent cavities. As the shunt contacts 156 are turned upwardly from the edge 160, the position of the upper contact portions 164 are clearly definable. In addition, two deflecting plates 170 are provided, which provides definable vertical downward deflection of the shunt contacts 156. The upward movement of the shunt contacts 156 is also easily definable for various different sizes of contacts. Furthermore, rear edges 168 of shunt contacts 156 provide a camming engagement, which allows for the deflection of the shunt members either from the front, or from the rear, which is more fully described in our concurrently filed patent application Ser. No. 11/810,232.

What is claimed is:

1. An electrical shunt member comprised of a base portion, a cantilever beam and a first shunt contact adjacent a free end of the cantilever beam, the cantilever beam and base portion being formed through a reverse bend, with the free end positioned opposite the reverse bend, the shunt contact including at least one upstanding contact formed upwardly from an edge of the cantilever beam, the shunt member further comprising a second shunt contact, whereby said first and second shunt contacts are profiled to common a plurality of electrical terminals.

2. The electrical shunt member of claim 1, wherein the cantilever beam is split into two sections, with a longitudinal seam extending between the two sections, each section including a respective first and second shunt contact formed upwardly from an outer edge of the respective cantilever beam.

3. The electrical shunt member of claim 2, further comprising a base portion, the cantilever beams and base portion being formed through a reverse bend wherein the longitudinal seam extends through a bight of the reversely bent portion.

4. The electrical shunt member of claim 3, wherein the free ends of the cantilever beam includes deflecting plates, which may be contacted to move the first and second shunt contacts to an unshunted condition.

5. The electrical shunt member of claim 4, wherein the deflecting plates are formed through an angle relative to the cantilever beams.

6. The electrical shunt member of claim 5, wherein the shunt contacts upstand in a direction opposite to the base portion, and the deflective plates are angled in a direction toward the base portion.

7. The electrical shunt member of claim 6, wherein the first and second shunt contacts can also be deflected into an unshunted position from a rear direction.

8. The electrical shunt member of claim 7, wherein an upper edge of the first and second shunt contacts are angled upwardly from rear to front.

9. The electrical shunt member of claim 1, wherein the first and second shunt contacts can be deflected from either the front or the rear.

10. An electrical connector, assembly comprising:

an insulating housing having a plurality of terminal receiving passageways, and a shunt member receiving cavity substantially spanning at least two of said terminal receiving passageways;

a plurality of electrical terminals positioned in at least some of the terminal receiving passageways;

an electrical shunt member positioned in the shunt member receiving cavity having at least two shunt contacts being movable between a shunted and unshunted position with selected electrical terminals, the shunt member comprising a longitudinal beam with the shunt contacts extending upwardly from an edge of the longitudinal beam.

11. The electrical connector assembly of claim 10, wherein the longitudinal beam is a cantilever beam split into two sections, with a longitudinal seam extending between the two sections, each section including a shunt contact formed upwardly from an outer edge of the respective cantilever beam.

12. The electrical connector assembly of claim 11, further comprising a base portion, the cantilever beams and base portion being formed through a reverse bend wherein the longitudinal seam extends through a root of the reverse bend.

13. The electrical connector assembly of claim 12, wherein the leading ends of the cantilever beam includes deflecting plates, which may be contacted to move the shunt contacts to an unshunted condition.

14. The electrical connector assembly of claim 13, wherein the deflecting plates are formed through an angle relative to the cantilever beams.

15. The electrical connector of claim 14, further comprising a base portion, the cantilever beam and base portion being formed through a reverse bend, with the free end position opposite the reverse bend.

16. The electrical connector assembly of claim 15, further comprising a front wall positioned over the electrical terminals, with apertures in alignment with the electrical terminals, and access ports accessing the electrical shunt member.

17. The electrical connector assembly of claim 16, wherein the front wall is defined by a terminal position assurance member received at a front end of the housing.

18. The electrical connector assembly of claim 17, further comprising a header connector.

19. The electrical connector assembly of claim 18, wherein the header connector includes camming elements aligned with the access ports to deflect the deflecting plates to move the shunt contacts to the unshunted position.

* * * * *